US009612003B2

(12) United States Patent
Cruz et al.

(10) Patent No.: US 9,612,003 B2
(45) Date of Patent: Apr. 4, 2017

(54) VANDAL RESISTANT LIGHT FIXTURE

(75) Inventors: William Cruz, Lauderhill, FL (US); Nicolae Povian, Cooper City, FL (US)

(73) Assignee: TALL TOWER LED, LLC, La Jolla, CA (US)

( * ) Notice: Subject to any disclaimer, the term of this patent is extended or adjusted under 35 U.S.C. 154(b) by 862 days.

(21) Appl. No.: 13/813,918

(22) PCT Filed: Aug. 26, 2011 (Under 37 CFR 1.47)

(86) PCT No.: PCT/US2011/049279

§ 371 (c)(1), (2), (4) Date: Apr. 28, 2014

(87) PCT Pub. No.: WO2012/027636

PCT Pub. Date: Mar. 1, 2012

(65) Prior Publication Data

US 2014/0247603 A1 Sep. 4, 2014

Related U.S. Application Data

(60) Provisional application No. 61/377,764, filed on Aug. 27, 2010.

(51) Int. Cl.

| | |
|---|---|
| ***F21V 15/00*** | (2015.01) |
| ***F21S 8/00*** | (2006.01) |
| ***F21S 8/04*** | (2006.01) |
| ***F21V 15/01*** | (2006.01) |
| ***F21V 17/10*** | (2006.01) |

(Continued)

(52) U.S. Cl.

CPC ..... *F21V 15/005* (2013.01); *F21K 9/232* (2016.08); *F21K 9/60* (2016.08); *F21S 8/033* (2013.01); *F21S 8/04* (2013.01); *F21V 15/01* (2013.01); *F21V 17/107* (2013.01); *F21V 21/02* (2013.01); *F21V 23/003* (2013.01); *F21V 15/013* (2013.01); *F21V 15/015* (2013.01); *F21V 23/04* (2013.01); *F21V 23/0442* (2013.01); *F21V 29/004* (2013.01); *F21Y 2101/00* (2013.01); *F21Y 2103/10* (2016.08); *F21Y 2115/10* (2016.08)

(58) Field of Classification Search

USPC ..... 362/362, 368, 369, 374, 375

See application file for complete search history.

(56) References Cited

U.S. PATENT DOCUMENTS

| | | | | |
|---|---|---|---|---|
| 2,327,230 A | | 8/1943 | Weber | |
| 4,893,221 A | * | 1/1990 | Friedman | F21L 4/04 362/108 |

(Continued)

FOREIGN PATENT DOCUMENTS

| | | |
|---|---|---|
| DE | 102009007308 A1 | 8/2010 |
| FR | 2727743 A1 | 6/1996 |

OTHER PUBLICATIONS

International Search Report mailed Mar. 12, 2012 for International Patent Application No. PCT/US2011/049279 of Cruz, W. filed Aug. 26, 2011.

(Continued)

*Primary Examiner* — Laura Tso

(74) *Attorney, Agent, or Firm* — Perkins Coie LLP

(57) ABSTRACT

A tamper-resistant light fixture having exceptional illuminance qualities, low energy consumption, and high resistance to unauthorized enclosure penetration.

28 Claims, 17 Drawing Sheets

(51) Int. Cl.

| | |
|---|---|
| ***F21V 21/02*** | (2006.01) |
| ***F21V 23/00*** | (2015.01) |
| ***F21K 9/232*** | (2016.01) |
| ***F21K 9/60*** | (2016.01) |
| *F21V 15/015* | (2006.01) |
| *F21V 23/04* | (2006.01) |
| *F21V 29/00* | (2015.01) |
| *F21Y 101/00* | (2016.01) |
| *F21Y 103/10* | (2016.01) |
| *F21Y 115/10* | (2016.01) |

(56) References Cited

U.S. PATENT DOCUMENTS

| | | | | |
|---|---|---|---|---|
| 5,272,605 | A * | 12/1993 | Johnstone | G08B 7/062 248/906 |
| 9,341,352 | B2 * | 5/2016 | Huang | F21V 19/02 |
| 2001/0036072 | A1 * | 11/2001 | Baker | F21S 8/032 362/146 |
| 2007/0086198 | A1 | 4/2007 | Wilson et al. | |
| 2010/0208474 | A1 * | 8/2010 | Hancock | F21K 9/00 362/375 |
| 2013/0258660 | A1 * | 10/2013 | Kim | F21V 21/00 362/235 |
| 2014/0016319 | A1 * | 1/2014 | Wendler | G09F 9/33 362/249.01 |

OTHER PUBLICATIONS

Written Opinion mailed Feb. 27, 2013 for International Patent Application No. PCT/US2011/049279 of Cruz, W. filed Aug. 26, 2011.

* cited by examiner

Illuminance - Cone of Light

| Illuminanace at a Distance | | | |
|---|---|---|---|
| Center Beam FC | | Beam Width | |
| 1.7ft | 305.82 fc | 3.5 ft | 4.0 ft |
| 3.3ft | 76.46 fc | 7.1 ft | 7.9 ft |
| 5.0ft | 33.98 fc | 10.6 ft | 11.9 ft |
| 6.7ft | 19.11 fc | 14.1 ft | 15.8 ft |
| 8.3ft | 12.23 fc | 17.7 ft | 19.8 ft |
| 10.0ft | 8.50 fc | 21.2 ft | 23.8 ft |
| Verti. Spread: 93.3° | | Horiz. Spread: 99.8° | |

Table 1

Figure 21

VANDAL RESISTANT LIGHT FIXTURE

CROSS-REFERENCE TO RELATED APPLICATION(S)

This application claims the benefit of U.S. Provisional Application No. 61/377,764, filed Aug. 27, 2010, the disclosure of which is hereby incorporated herein by reference in its entirety.

TECHNICAL FIELD

This invention relates to the field of specialty lighting fixtures.

BACKGROUND

Numerous and varied environments require the use of reinforced, tamper or vandal resistant light fixtures. Tamper-resistant light fixtures are often used in prisons/jails, schools, hospitals, and industrial locations. Each of these environments presents unique challenges to providing safe, efficient, and high quality lighting.

For example, in prisons, jails or other types of custodial facilities, inmates often attempt to breach the housings of light fixtures in their rooms to hide contraband, start fires, or remove components to be used as weapons. Another example is, in schools, where juvenile delinquents and hooligans often attempt to damage or steal lighting fixtures. Yet another example is in healthcare facilities where light fixtures are often exposed to fluids or impacts. In addition, in some public areas, such as parks, walkways or parking lots, criminals attempt to destroy lighting fixtures to reduce visibility and illumination, thereby facilitating illicit activities under the cover of darkness.

Over the years, various surface-mounted lighting fixtures have been developed to provide for improved tamper-resistance. These have included "shoebox," "clamshell," and "unibody" style lighting fixtures. Shoebox designs generally involve a box housing with a hinged top. Clamshell designs normally have a door and sidewalls that are hinged to a pan. Unibody designs involve a housing formed from a unitary structure, as described in U.S. Pat. No. 7,431,473.

Unfortunately, available lighting fixtures have numerous drawbacks and shortcomings that make them less than ideal for custodial, school, healthcare and outdoor uses. One problem with many currently available lighting fixtures is their high energy consumption. Another problem is that they require frequent maintenance to change burned-out incandescent bulbs, fluorescent bulbs, ballast, or in some cases compact fluorescent bulbs. Still another problem is in their abysmally poor light quality and illuminance characteristics. This latter problem is particularly important in environments where poor light quality can have a deleterious effect on morale or mood.

SUMMARY

The foregoing problems and drawbacks associated with previously available tamper-resistant lighting fixtures are resolved or at least substantially improved and a technical advance is achieved in a vandal resistant lighting fixture according to the present invention.

In one embodiment of the present invention, a light fixture is disclosed having a housing with a base and a side wall(s) connected to the base. A support beam extends laterally from the housing wall(s) and away from a central axis of the housing. The support beam is provided with a securing recess(es) to connect the light fixture to a ceiling or other surface. In addition, the light fixture has one or more swing doors rotatably mounted to the housing wall such that the swing doors lock against the wall and limit access to the support beam. The swing doors can be locked with cantilevered snap fit prongs, for example. In addition, a polycarbonate resin thermoplastic lens is slidably mounted between the housing walls and end caps to form an enclosure that is resistant to attack or vandalism.

In addition, the light fixture is provided with pedestals connected to the base. The pedestals support a light source, such as a light emitting diode, which can be selectively controlled by a user. The resulting light fixture has exceptional illuminance characteristics.

In another embodiment of the present invention, a light fixture is disclosed having a housing with a base and a side wall(s) connected to the base. A cantilevered snap fit mounting bracket is configured to be snap fit mounted to the housing. The cantilevered snap fit mounting bracket is provided with securing recess(es) to connect the bracket and, in turn, the light fixture to a ceiling or other surface. In addition, a polycarbonate resin thermoplastic lens is slidably mounted between the side walls and end caps to form an enclosure that is resistant to attack or vandalism.

Numerous additional embodiments of the present invention will become apparent to one of ordinary skill in view of the present disclosure.

BRIEF DESCRIPTION OF THE DRAWINGS

FIG. 21 illustrates a perspective bottom view of a vandal resistant light fixture with the lower cap 20 removed showing different light sources 61.

DETAILED DESCRIPTION

The following detailed description and the appended drawings describe and illustrate exemplary embodiments of the invention solely for the purpose of enabling one of ordinary skill in the relevant art to make and use the invention. As such, the detailed description and illustration of these embodiments are purely exemplary in nature and are in no way intended to limit the scope of the invention, or its protection, in any manner. It should also be understood that the drawings are not to scale and in certain instances details have been omitted, which are not necessary for an understanding of the present invention, such as conventional details of fabrication and assembly.

Figure 1:
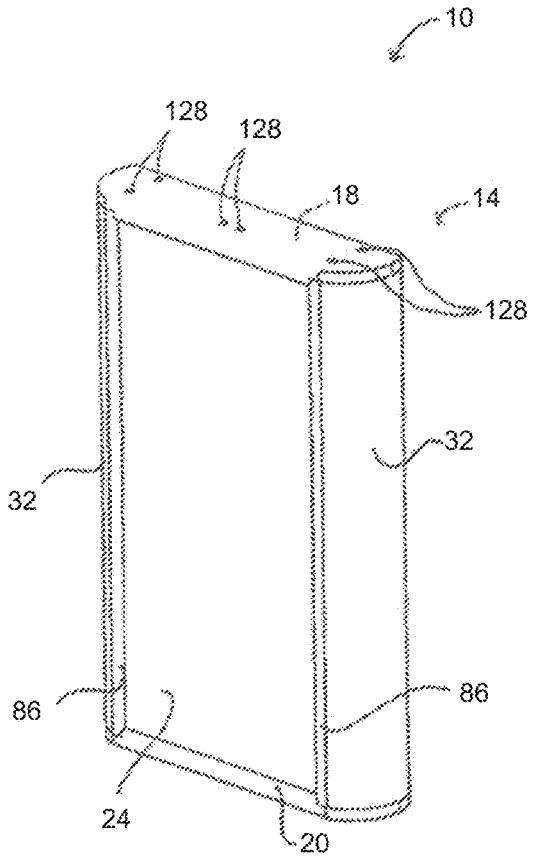
FIG. 1 illustrates a front perspective view of a vandal resistant light fixture according to one aspect of the present invention.
Figure 2:
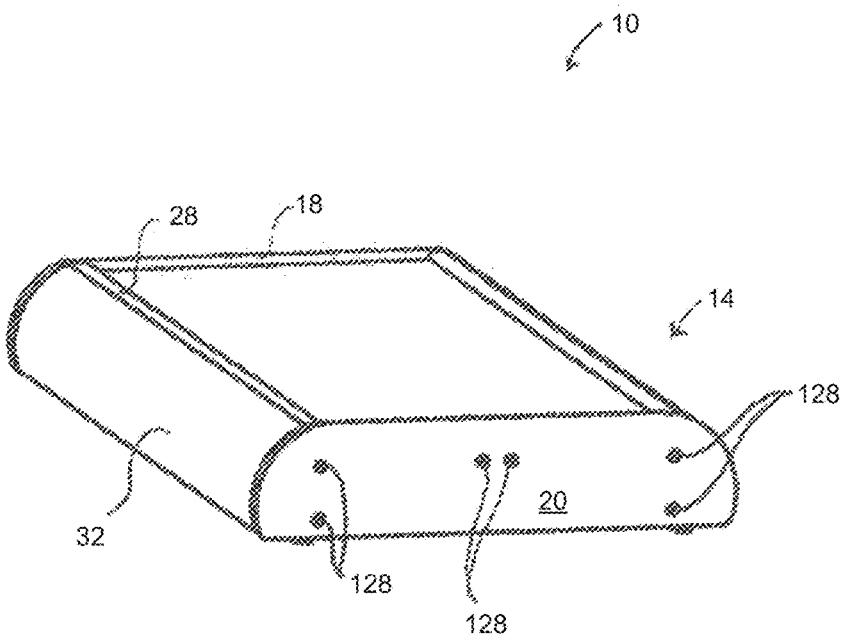
FIG. 2 illustrates a bottom perspective view of a vandal resistant light fixture according to one aspect of the present invention.
Figure 3:
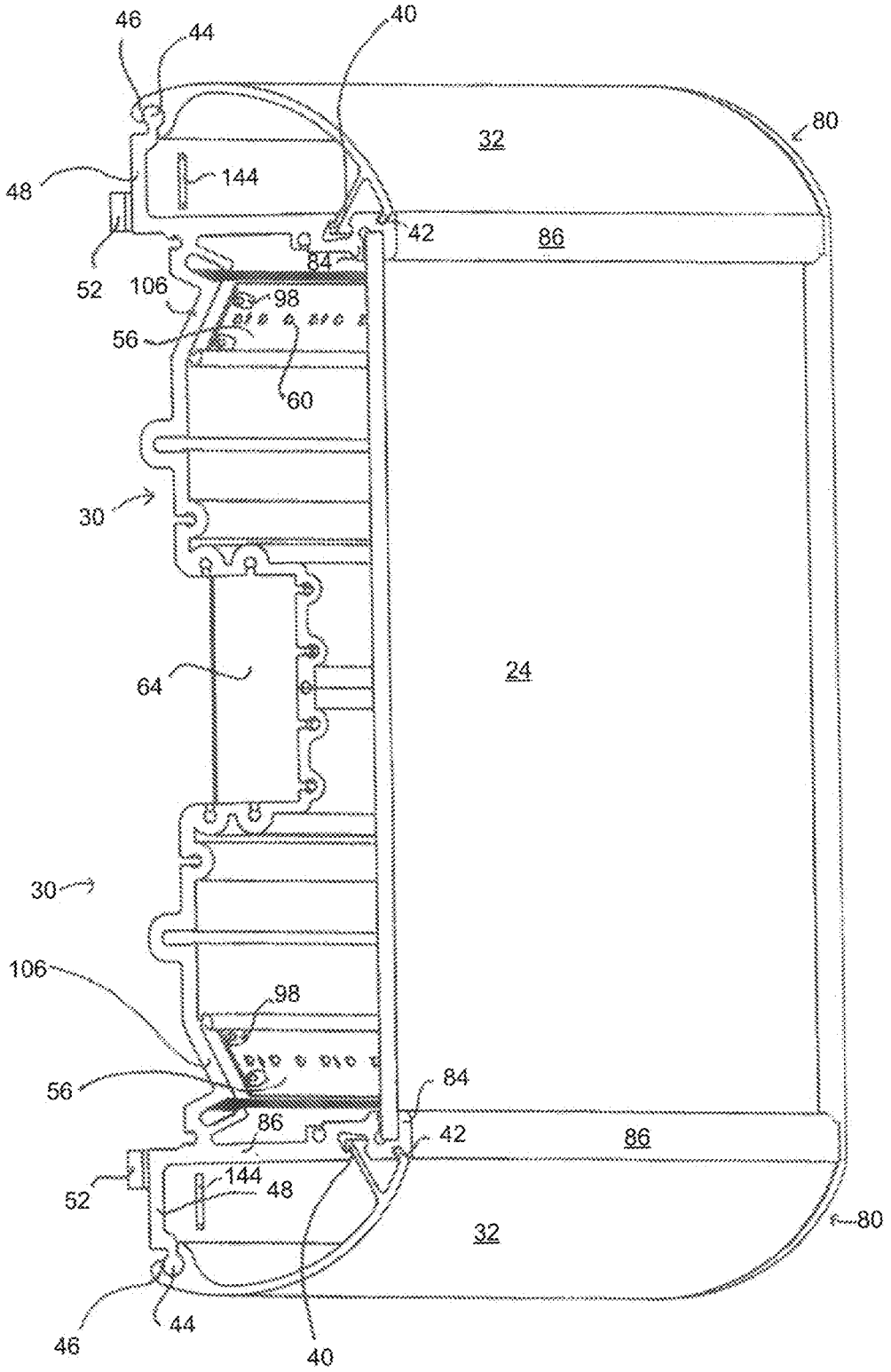
FIG. 3 illustrates a perspective bottom view of a vandal resistant light fixture without the lower cap 20 according to one aspect of the present invention.
Figure 4:
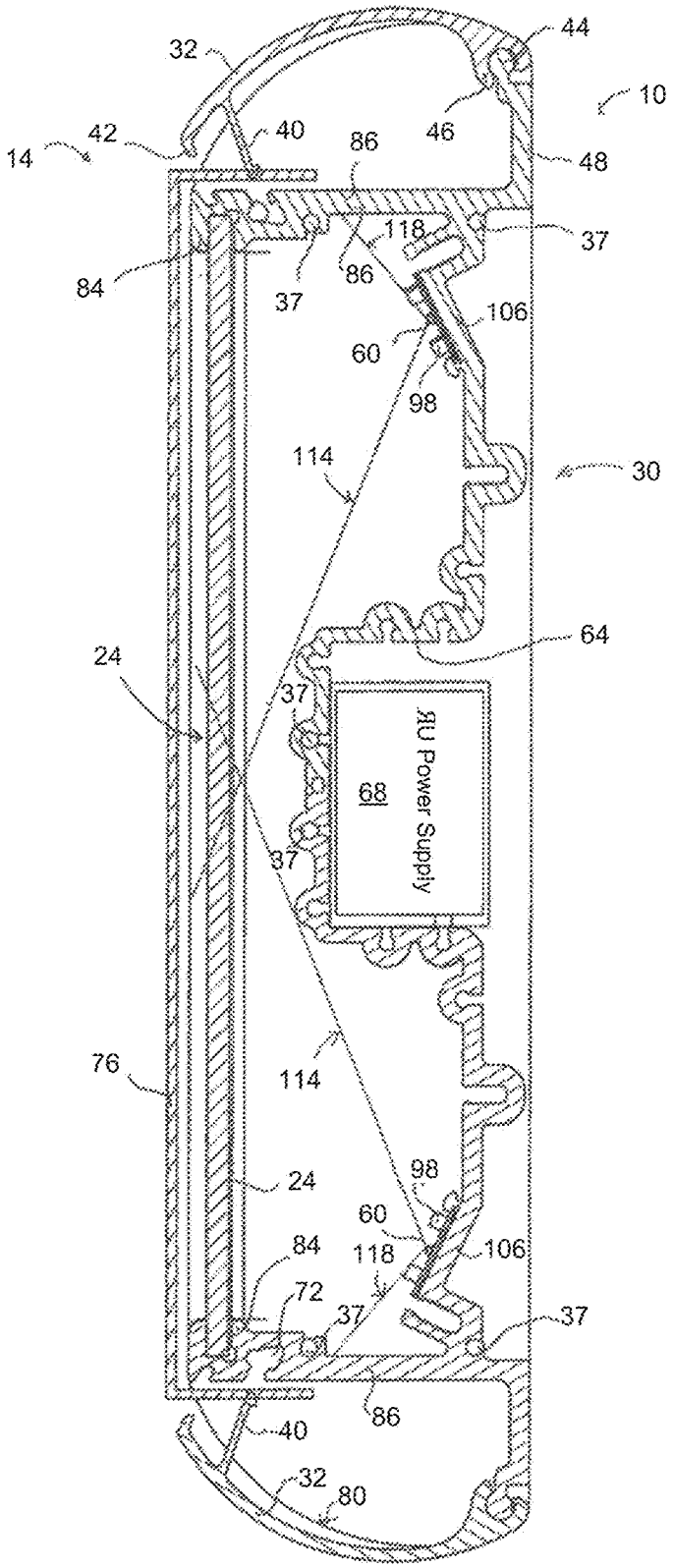
FIG. 4 illustrates a bottom side view of a vandal resistant light fixture according to one aspect of the present invention.
Figure 5:
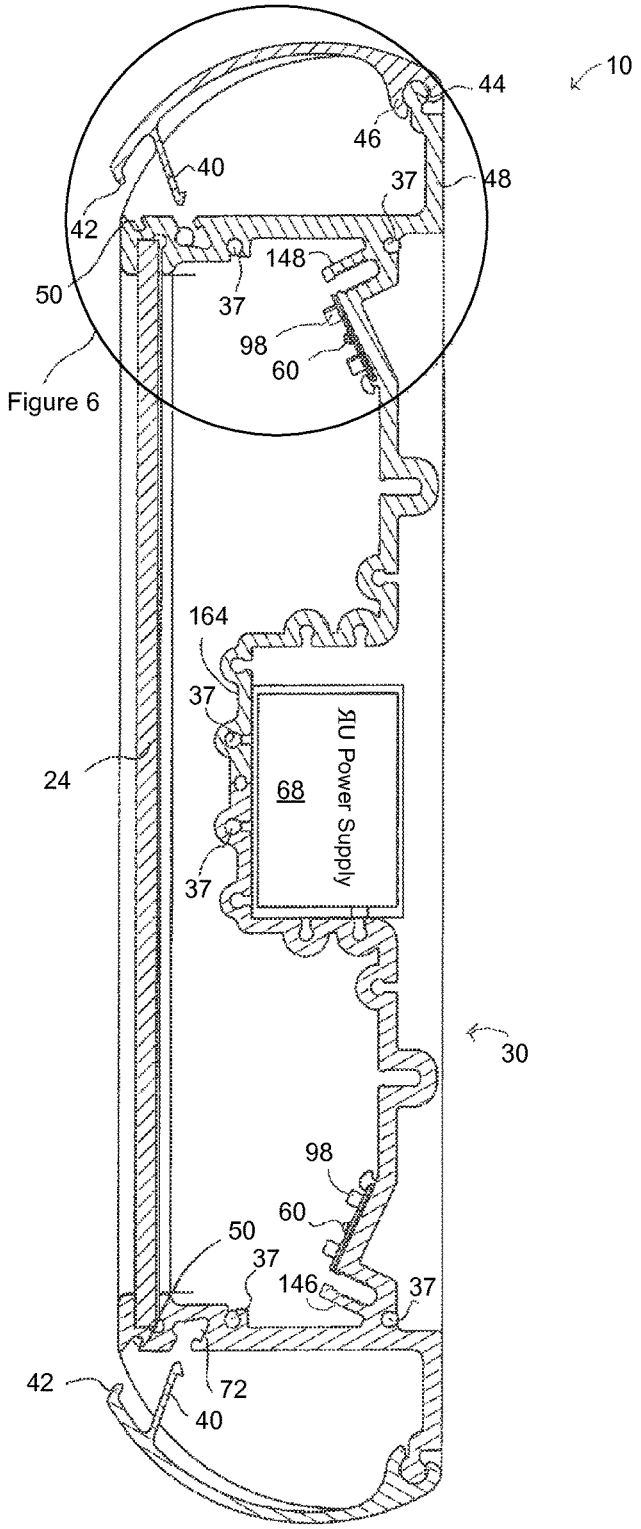
FIG. 5 illustrates a bottom side view of a vandal resistant light fixture according to one aspect of the present invention.
Figure 12:
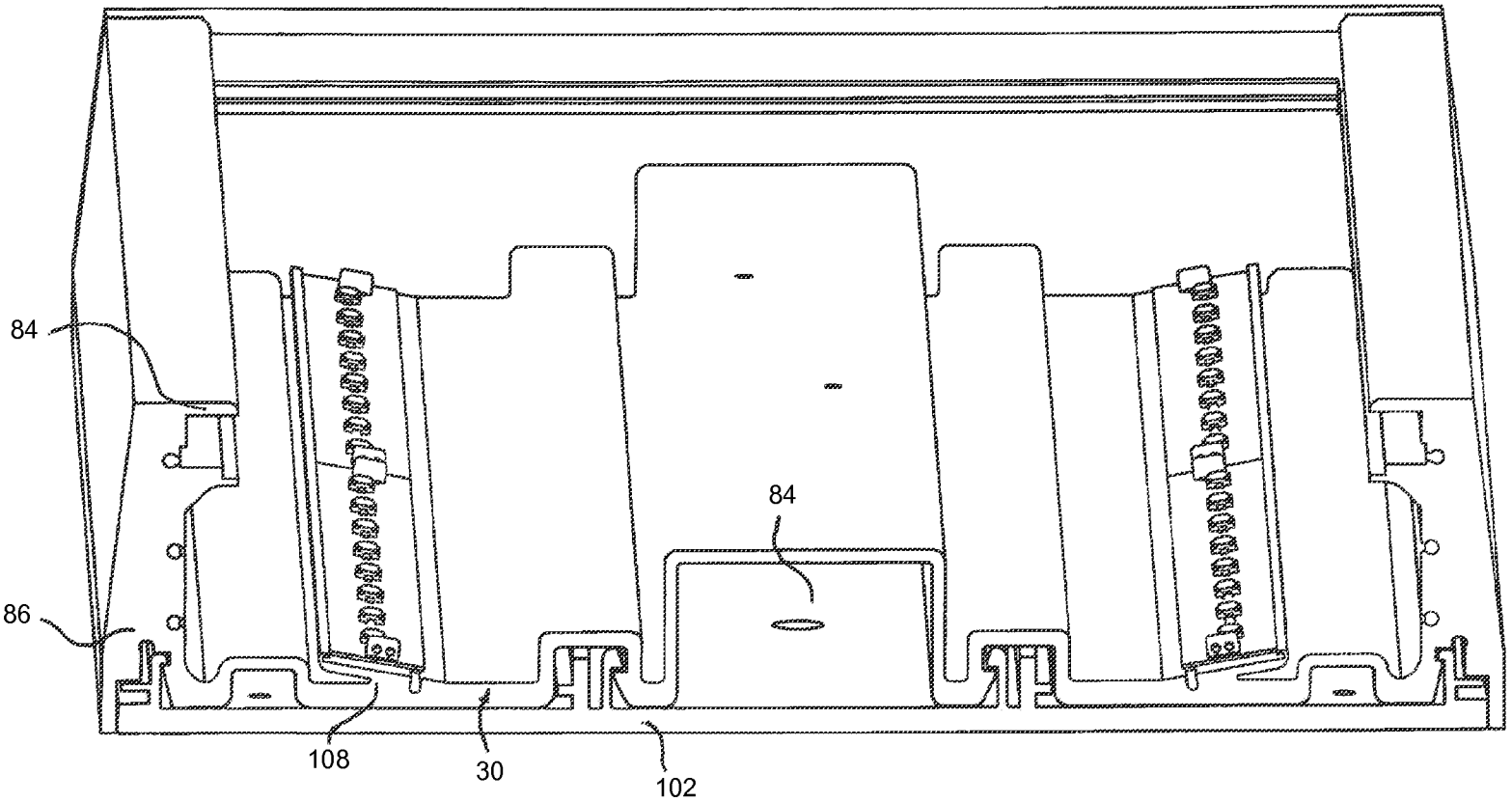
FIG. 12 illustrates a bottom perspective view of a vandal resistant light fixture according to one aspect of the present invention.
Figure 13:
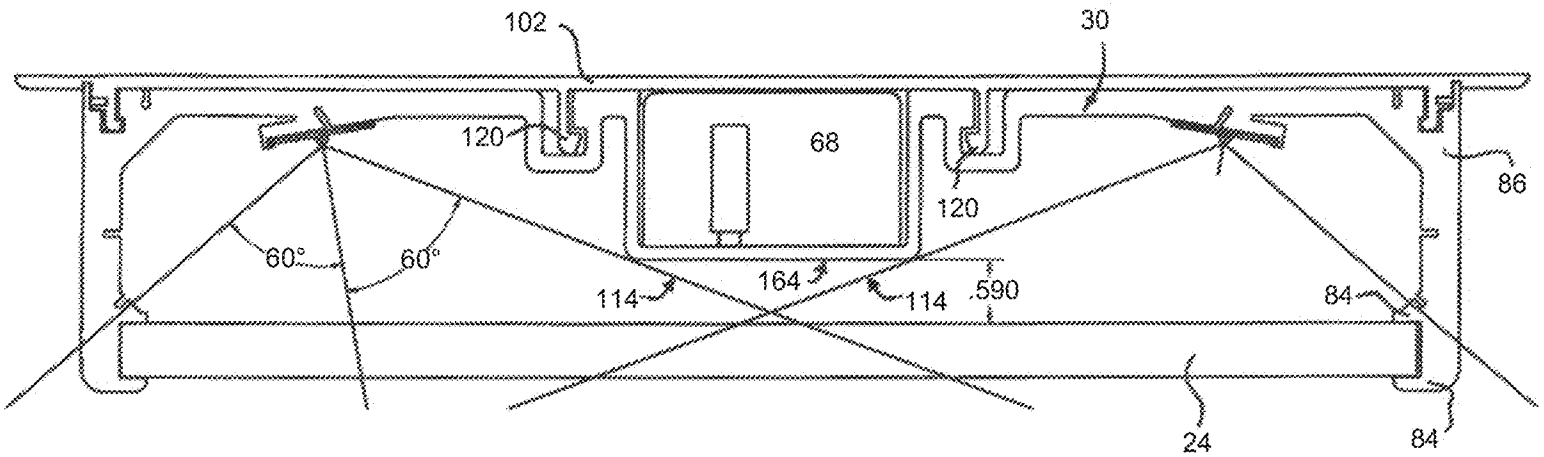
FIG. 13 illustrates a side view of a vandal resistant light fixture according to one aspect of the present invention.
Figure 14:
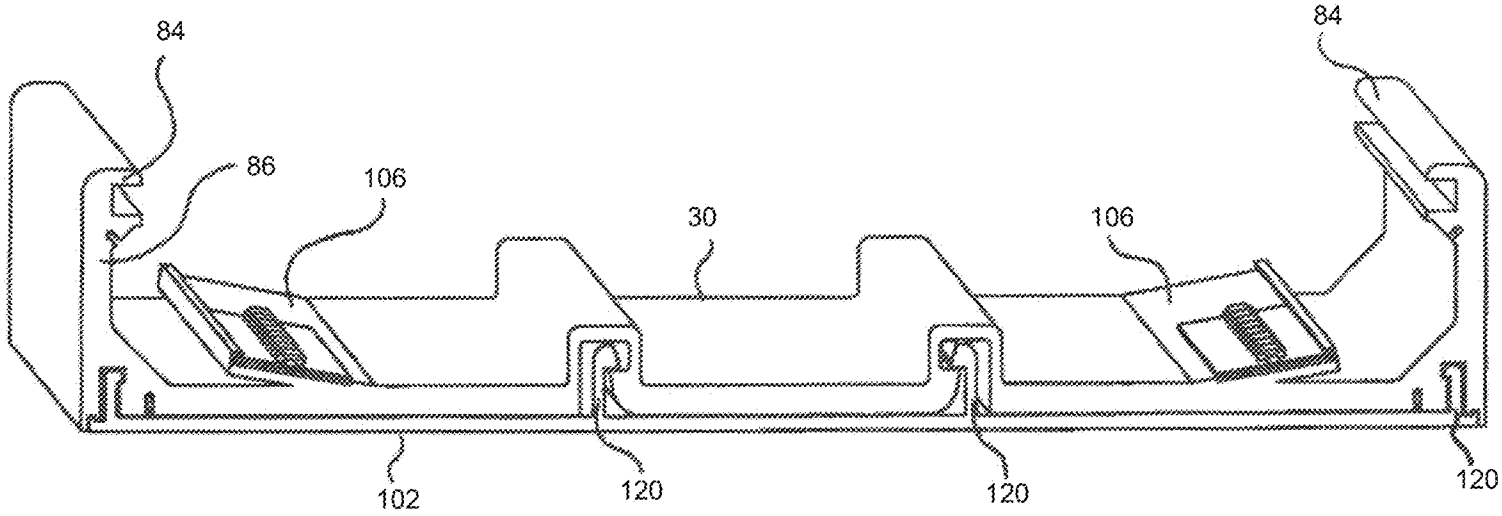
FIG. 14 illustrates a bottom perspective view of a vandal resistant light fixture according to one aspect of the present invention.
Figure 15:
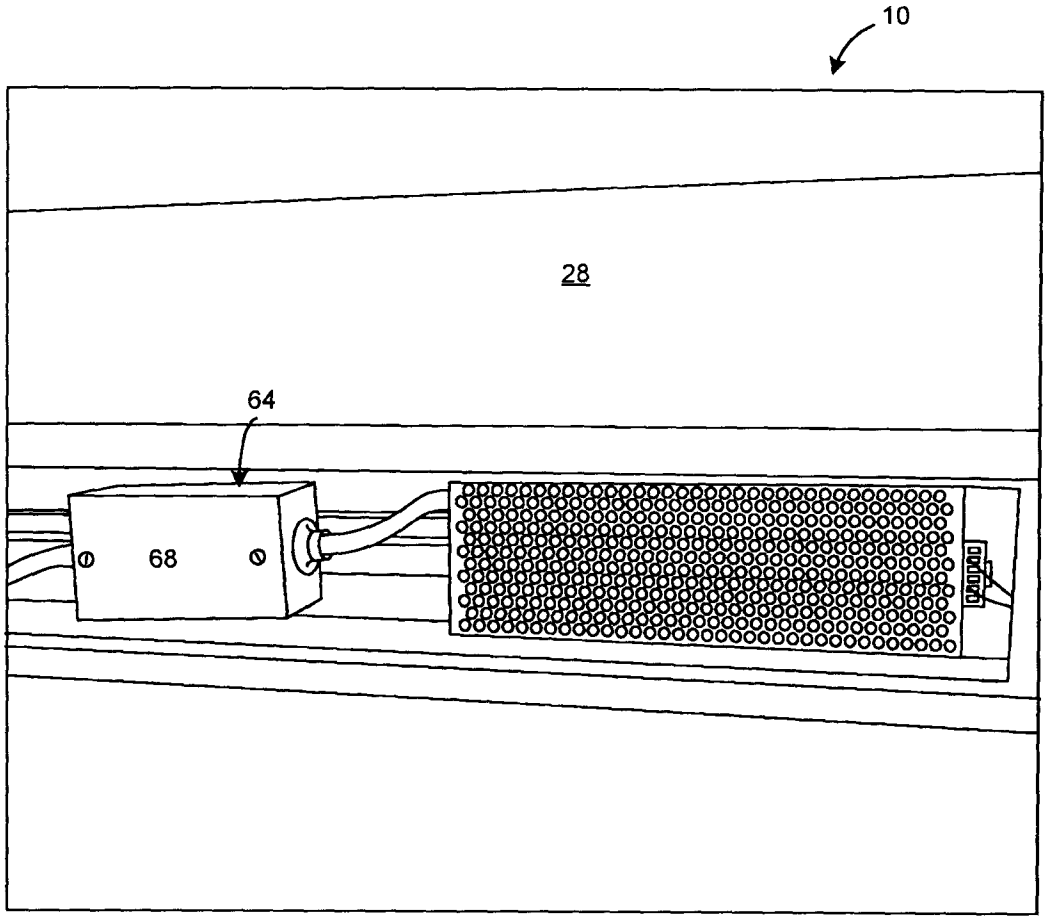
FIG. 15 illustrates a back perspective view of a vandal resistant light fixture according to one aspect of the present invention.

Turning to the drawings, FIGS. 1-2 generally illustrate one preferred embodiment of a vandal resistant light fixture 10. Referring to FIG. 1, fixture 10 includes a vandal resistant housing 14, upper and lower end caps 18 and 20, respectively, and a lens 24. In addition, as best illustrated in FIGS. 4-5, a light emitting diode (LED) panel board 56 having an array of LEDs 60 is mounted within housing 14 on inclined pedestal 106. Light sources can be selected from the group consisting of a light emitting diode, an incandescent bulb, a fluorescent bulb, and a compact fluorescent bulb. The LEDs 60 are powered by a power supply 68, which can be provided within power supply housing 64 (FIGS. 3-5, 12-15). In one embodiment, a LED controller circuit 124 is positioned adjacent lens 24 and allows a user to tap lens 24 proximate the LED controller circuit to turning on, off, or adjusting the intensity of illumination. As illustrated in FIGS. 3-5, housing 14 can be anchored to a surface such as a ceiling or wall with anchors connected through mounting bores 144. In an alternative embodiment, as illustrated in FIGS. 12-14, housing 14 can be securely fastened or anchored to a surface such as a wall or ceiling with cantilevered snap-fit mounting bracket 102 with cantilevered snap fit prongs 120.

FIGS. 1-3 illustrate housing 14. Housing 14 is preferably formed from a hard material that can withstand severe, repeated impacts. For example, in one preferred embodiment, housing 14 is formed from an extruded metal alloy such as aluminum 6063 cut to a desired length. As shown in FIGS. 3-5, and 12-14, housing 14 includes a base 30 and side walls or pillars 86. Base 30 and pillars 86 form an interior, open-ended, U-shaped channel that houses LED panel board 56.

Figure 7:
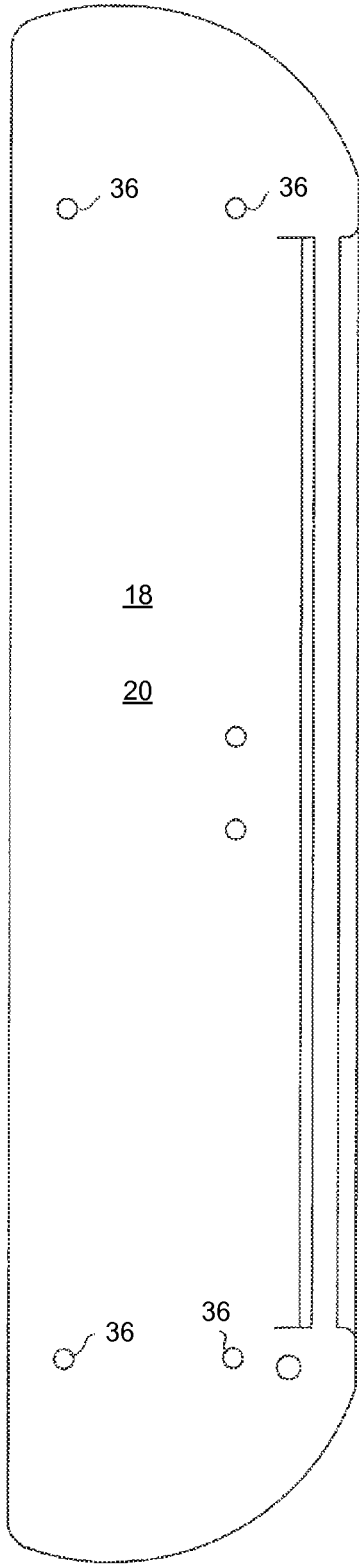
FIG. 7 illustrates a top view of an upper and a lower end cap of a vandal resistant light fixture according to one aspect of the present invention.

An impact-resistant, polycarbonate lens 24 (FIG. 1) and end caps 18 and 20 (FIGS. 1, 2, and 7) fully enclose housing 14. Lens 24 is preferably made of a highly impact resistant, translucent material such as a polycarbonate resin thermoplastic. One preferred brand of polycarbonate resin thermoplastic is Lexan (R), which can be acquired from SABIC Innovative Plastics, Pittsfield, Mass. Lens 24 is selected based on the maximum level of impact likely to be encountered in a particular application. For example, for prisons and jails, relatively thick polycarbonate is necessary to provide a significant impact and penetration barrier. Schools, on the other hand, are likely to need a somewhat thinner lens. In addition, lens 24 is preferably provided with translucent characteristics, i.e., frosting, that diffuses light emitted from the LEDs.

Figure 8:
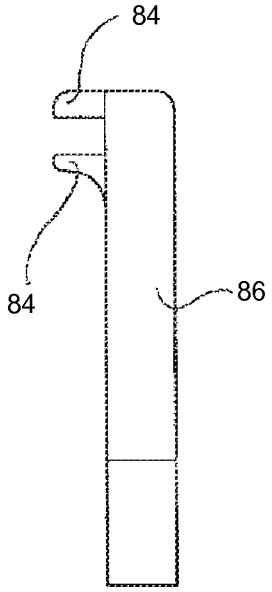
FIG. 8 illustrates a side view of an end cap of a vandal resistant light fixture according to one aspect of the present invention.

Lens 24 is slidably mounted to housing 14, as shown in FIGS. 3-6. In one preferred embodiment illustrated at FIG. 3, lens 24 is positioned between opposing pillars 86 (FIG. 8). More particularly, lens 24 is retained in a groove formed by a skirt 84. Once lens 24 is properly positioned, end caps 18 and 20 secure lens 24 to housing 14. Additionally, a lens support 164 is provided to prevent flexing of lens 24 to a point where it could crack or be displaced from skirt 84.

Figure 9:
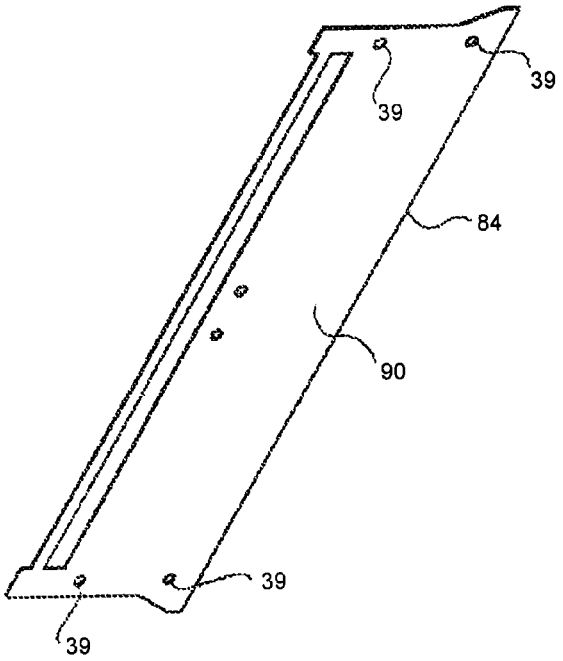
FIG. 9 illustrates a perspective side view of a seal of a vandal resistant light fixture according to one aspect of the present invention.

FIGS. 1 and 2 illustrate the use of top and bottom end caps 18 and 20 to enclose the top and bottom ends of housing 14. Preferably, top and bottom end caps 18 and 20 are secured to housing 14 by one-way or security screws 128 (FIGS. 1-2) inserted through bores 36 (FIG. 7) in end caps 18 and 20 and into bores 37 (FIG. 4) in housing 14. Alternative means of securing end caps 18 and 20 to housing 14 will be apparent in view of the present disclosure to one of ordinary skill. End caps 18 and 20 are preferably formed from a metal alloy or other rigid material that is impact resistant. In addition, to improve moisture resistance of housing 14, a gasket 90 can be used between each end cap and the housing. Gasket 90, as illustrated in FIG. 9, is preferably provided with bores 39 that correspond with bores 36 and 37 to facilitate installation of the end caps. A seal or sealant can also be used in connection with skirts 84 to improve moisture resistance.

Figure 6:
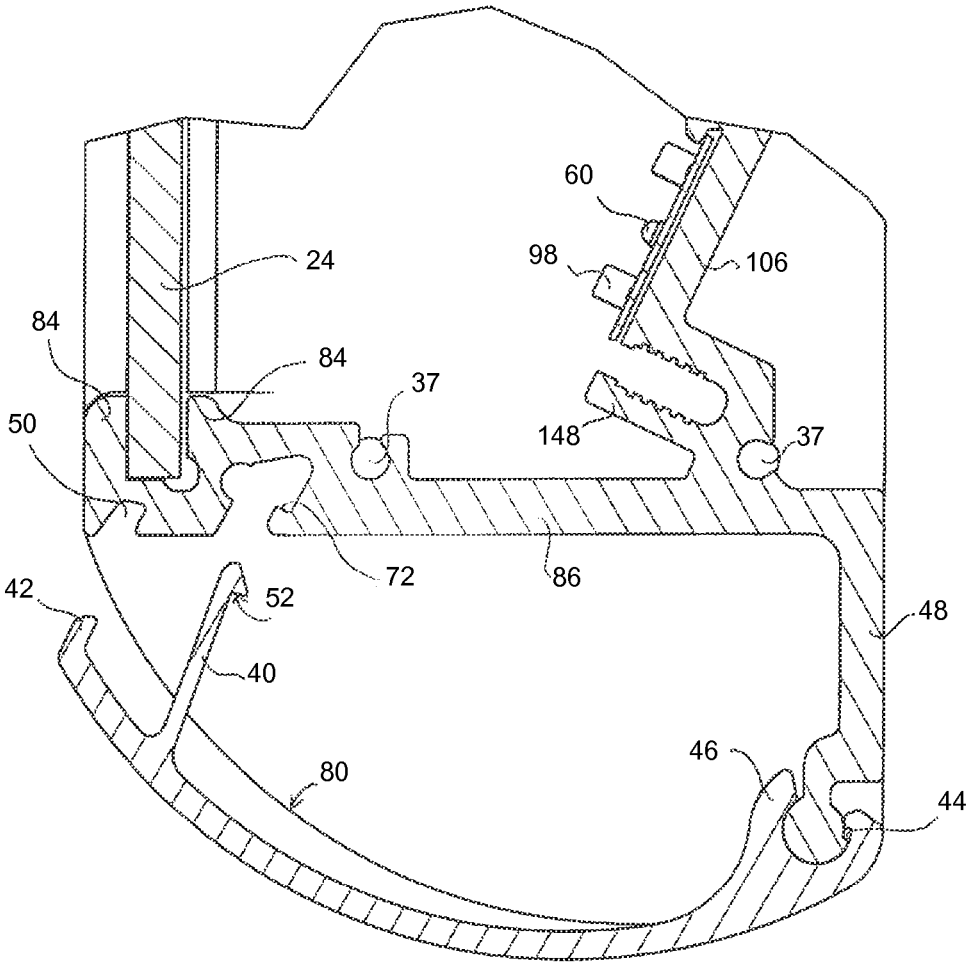
FIG. 6 illustrates a partial bottom view of a vandal resistant light fixture according to one aspect of the present invention.

In one preferred embodiment illustrated in FIGS. 1-6, a locking mounting mechanism prevents unauthorized removal of housing 14 from the mounting surface on which fixture 10 is mounted. In this preferred embodiment, fixture 10 is mounted to a mounting surface with fasteners inserted through bores 144 (FIG. 3) provided through lateral beam 48. Once fixture 10 is securely mounted to the mounting surface, exterior swing doors can be moved to a locked position. In particular, as best shown in FIGS. 4-6, exterior swing doors 32 are hinged on one end with a hinge barrel 46 that pivots about hinge pivot 44 on lateral beam 48. The opposite end of the exterior swing doors 32 includes a cantilevered a snap fit 40, and tongue 42. When swing doors 32 are moved to a closed position 80 (FIG. 3), cantilevered snap fit 52 engages snap fit recess shoulder 72, thus securing the doors 32 shut. Tongue 42 seats within groove 50 and prevents access to the cantilevered snap fit 52, and thus opening the swing doors.

Figure 18:
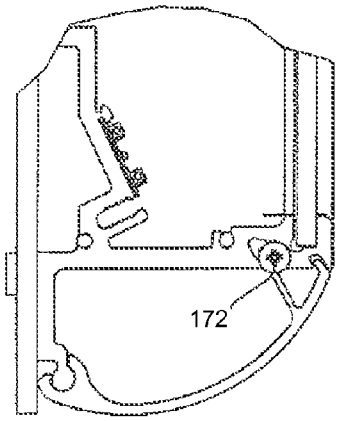
FIG. 18 illustrates a partial cutout of a top view of a vandal resistant light fixture according to one aspect of the present invention.
Figure 17:
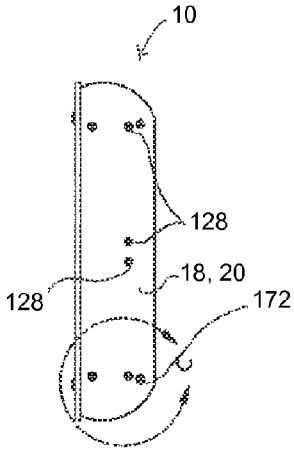
FIG. 17 illustrates a top view of an enclosed vandal resistant light fixture according to one aspect of the present invention.
Figure 19:
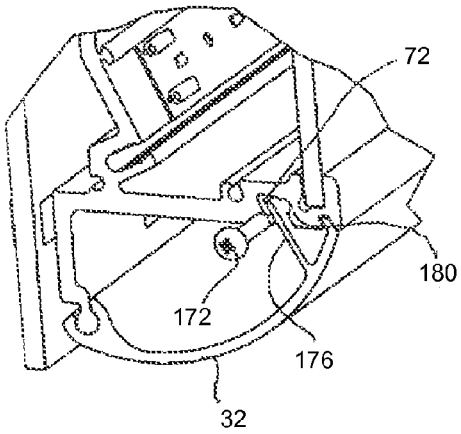
FIGS. 19 and 20 illustrate a partially exploded, perspective top view of a vandal resistant light fixture according to one aspect of the present invention.
Figure 16:
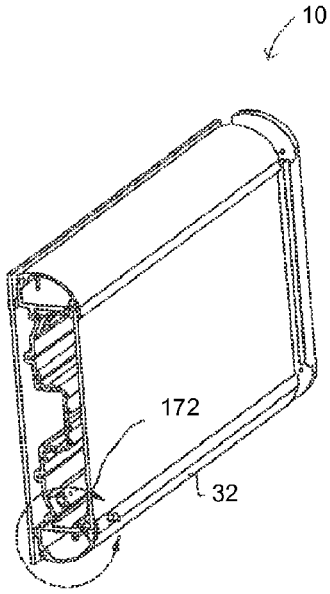
FIG. 16 illustrates a bottom perspective view of a vandal resistant light fixture according to one aspect of the present invention.
Figure 20:
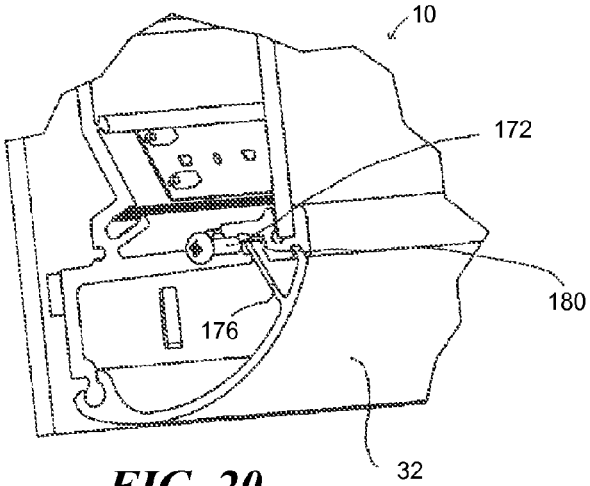

FIGS. 16-20 illustrate an alternative mechanism for locking swing doors 32. In particular, a one-way or security screw 172 can be used to restrict movement of swing doors 32. In this embodiment, instead of a cantilevered snap fit, swing doors 32 are provided with tongue 176. As shown in FIG. 19, tongue 176 is configured to seat in groove 72. In this embodiment, groove 72 is provided with a bore 180 for receiving screw 172. When the swing doors are in a closed position (FIGS. 19-20), upper cap 18 and lower cap 20 can be positioned over housing 14 such that bore holes 128 align with fastening bores 37. When caps 18, 20 are in position, screws 172 can be screwed into bore 180, thereby restricting movement of tongue 176 and, in turn, securing swing doors 32 (FIG. 18). It should be noted that, although FIG. 18 illustrates screw 172 in its final position, an end cap is not shown in order to more clearly illustrate the function of screw 172 in preventing movement of tongue 176. In one preferred embodiment, screw 172 can be inserted over caps 18 and 20 (FIG. 17).

Figure 11:
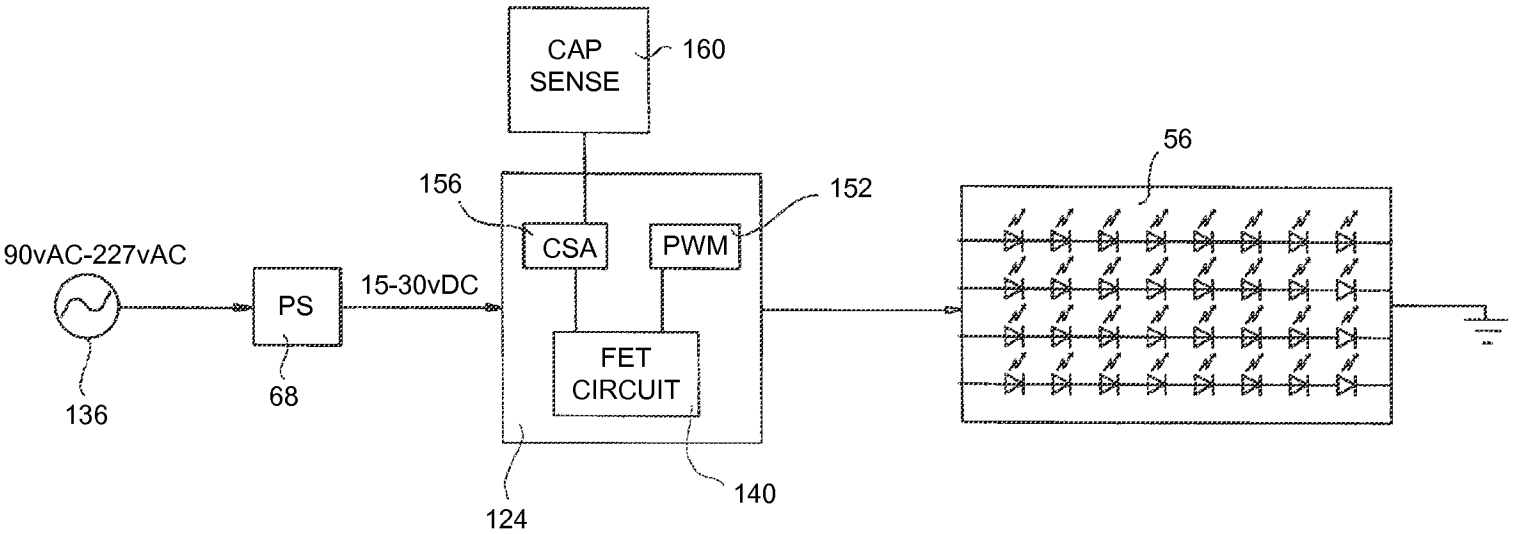
FIG. 11 illustrates a block diagram of a power supply and LED controller circuit in accordance with one embodiment of the present invention.

FIG. 11 discloses a block diagram of the electronic components of the fixture 10, and in particular, an LED controller circuit 124. As illustrated, a power supply 68 is connected to the facility current point 136, which can be an electrical outlet or other alternating current source (for example, 90vAC-277vAC). Power supply 68 is configured to provide approximately 15-30 volts of Direct Current to an LED controller circuit 124. As shown in FIG. 11, LED controller circuit 124 includes a pulse width modulator 152 (PWM), a capacitance sensor reader 156 (in a preferred embodiment, CapSense Successive Approximation (CSA) reader), a capacitance sensor 160 for controlling light intensity, a FET (field-effect transistor) drive circuit 140 and the LED panel board 56. In this embodiment, the signal from the capacitance sensor 160 controls PWM 152 so that pulses of different width are outputted to control the light intensity. PWM 152 signals are amplified by FET 140 to drive the LEDs 60. Accordingly, in a preferred embodiment, a user can turn on, turn off and adjust the brightness of one or more LEDs 60 (or groups of LEDs in other embodiments) in fixture 10.

The use of a capacitance sensor situated inside housing 14 allows a user to control the light without an external switch that is susceptible to impact, damage or removal. That is, in some embodiments, the light intensity may be selectively increased or decreased by tapping a capacitance sensor that, for example, may be attached to the inner side of the lens. In a preferred embodiment there is a multiple tap, more preferably three tap dimming cycle. In certain preferred embodiments, including those with multiple tap dimming cycles, the light may be set so that there is never an option for the light to be in a full off position, thereby increasing the lifespan of the electronics.

Complete enclosure of fixture 10 traps heat generated during operation. In certain embodiments, this may lead to accumulation of excess heat that could damage parts of the light fixture 10. In certain preferred embodiments, a board for mounting the LEDs, preferably an FR4 board, includes a number of orifices 94 and metal plates 98 on a side of the board opposite to the LEDs to assist in diffusing heat generated by the LEDs. Similarly, in other preferred embodiments, a board for mounting the LED controller includes a number of orifices and/or includes one or more metal plates on a side of the board opposite to the LED controller to assist in heat diffusion from the LED components.

Figure 10:
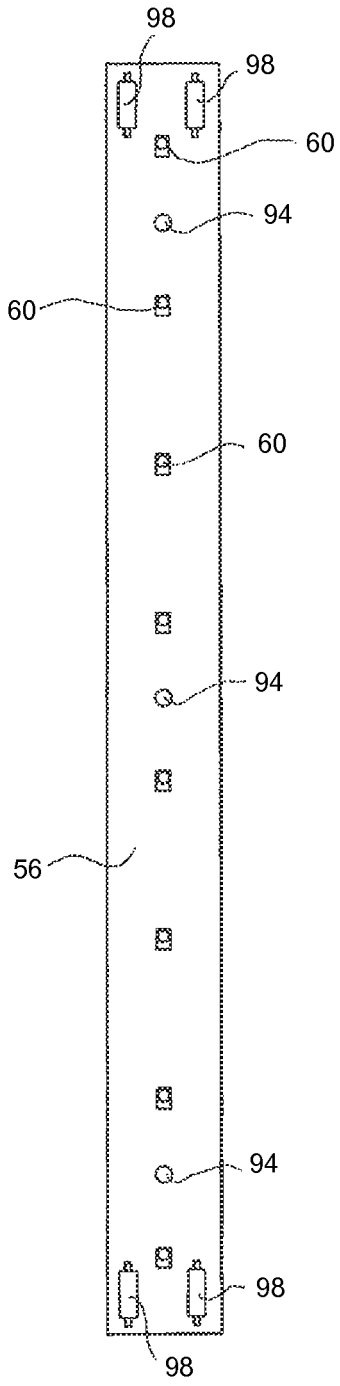
FIG. 10 illustrates a top view of an LED panel board of a vandal resistant light fixture according to one aspect of the present invention.

Referring now to FIG. 4, the LED panel board 56 (FIG. 10) is mounted to a pedestal 106 with heat diffusers 146 and 148. As illustrated in FIGS. 4-6 and 12-14, each of the two pedestals 106 are inclined toward a central portion of housing 14. This pedestal arrangement creates a cone of light 114 and 118 (FIG. 4) that provides high quality illuminance, as illustrated in Table 1 below. In one preferred embodiment, 32 LEDs are used to provide a vertical spread of illuminance of approximately 93.3 degrees, and a horizontal spread of illuminance of approximately 99.8 degrees. As a result, fixture 10 provides a cone of light and foot candles as disclosed in the following Table 1.

The foregoing detailed description provides exemplary embodiments of the invention and includes the best mode for practicing the invention. The description and illustration of embodiments is intended only to provide examples of the invention and not to limit the scope of the invention or its protection in any way.

We claim:

1. A light fixture comprising:

a housing comprising a base and a wall connected to the base, thereby defining a base perimeter and an interior portion;

a beam extending laterally from the wall and away from the interior portion, the beam having a securing recess;

a door pivotally mounted to the beam, the door having a securing means for locking the door to the wall and limiting access to the beam;

a lens connected to the wall, thereby defining an enclosed area; and a light source within the enclosed area.

2. The light fixture of claim 1, further comprising a means for restricting access to the securing means.

3. The light fixture of claim 1 wherein the light source is a light emitting diode.

4. The light fixture of claim 3, further comprising a pedestal for supporting the light emitting diode, the pedestal being connected to one of the base and the wall.

5. The light fixture of claim 4 wherein the pedestal is inclined relative to the base.

6. The light fixture of claim 3, further comprising a light emitting diode control circuit operatively connected to the light emitting diode, the control circuit comprising a capacitance sensor.

7. The light fixture of claim 6 wherein the control circuit is configured to only control light intensity.

8. The light fixture of claim 6 further comprising a means for limiting flexion of the lens.

9. The light fixture of claim 1, further comprising a second beam extending laterally from the wall and away from the interior portion, the second beam having a securing recess; and a swing door rotatably mounted to the second beam and having a securing means for locking the swing door to the wall, and limiting access to the beam.

10. A light fixture comprising:

a housing comprising a base and a wall connected to the base, thereby defining a base perimeter and an interior portion, the base having a plurality of recesses with retaining shoulder;

a mounting bracket having a cantilevered snap fit prong for engaging the retaining shoulder and securing the mounting bracket to the base;

a diffuser lens connected to the wall, thereby defining an enclosed area;

an array of light emitting diodes connected to one of the base, the wall, and the lens; the array of light emitting diodes being arranged in at least two rows of lights.

11. The light fixture of claim 10, wherein during operation the housing emits light having a vertical spread substantially close to 93.3 degrees.

12. The light fixture of claim 10, wherein during operation the housing emits light having a horizontal spread substantially close to 99.8 degrees.

13. The light fixture of claim 10 further comprising a light emitting diode control circuit operatively connected to the array of light emitting diodes, the light emitting diode comprising a capacitance sensor.

14. The light fixture of claim 10, further comprising a pedestal forming a support on the base for the array of light emitting diodes, and the pedestal being inclined relative to the base.

15. A light fixture having an illuminated position in which the light fixture emits light, the light fixture comprising:

a housing comprising a base and a wall defining an interior portion;

a means for securing the housing to a surface;

a lens connected to the wall, thereby defining an enclosed space;

a pedestal connected to the base within the interior portion;

a light source connected to the pedestal;

a light source control operably connected to the light source for adjusting the intensity of the light emitted in the illuminated position;

wherein, in the illuminated position, the first and second light sources create an illuminance light cone having one of a vertical spread of illuminance substantially close to 93.3 degrees and a horizontal spread of illuminance substantially close to 99.8 degrees.

16. The light fixture of claim 15 further comprising a means for preventing flexion of the lens.

17. The light fixture of claim 16, wherein the first and second light sources are selected from the group consisting of a light emitting diode, an incandescent bulb, a fluorescent bulb, and a compact fluorescent bulb.

18. The light fixture of claim 17 wherein in the illuminated position the fixture generates about 305 foot candles of light at a distance of about 1.7 feet from the fixture.

19. The light fixture of claim 18 wherein the lens is formed from a polycarbonate material and is frosted.

20. The light fixture of claim 15, 16, or 17, further comprising:

an elongate board defining a plurality of openings, the board being connected to the pedestal; and a plate connected to the board, wherein the openings defined by the board and the plate diffuse heat.

21. The light fixture of claim 15, 16, or 17, further comprising a heat diffuser connected to the light source.

22. The light fixture of claim 2, wherein the light source is a light emitting diode.

23. The light fixture of claim 4, further comprising a light emitting diode control circuit operatively connected to the light emitting diode, the control circuit comprising a capacitance sensor.

24. The light fixture of claim 3, further comprising a second beam extending laterally from the wall and away from the interior portion, the second beam having a securing recess; and a swing door rotatably mounted to the second beam and having a securing means for locking the swing door to the wall, and limiting access to the beam.

25. The light fixture of claim 6, further comprising a second beam extending laterally from the wall and away from the interior portion, the second beam having a securing recess; and a swing door rotatably mounted to the second beam and having a securing means for locking the swing door to the wall, and limiting access to the beam.

26. The light fixture of claim 6, further comprising a means for limiting flexion of the lens.

27. The light fixture of claim 11, wherein during operation the housing emits light having a horizontal spread substantially close to 99.8 degrees.

28. The light fixture of claim 11, further comprising a light emitting diode control circuit operatively connected to the array of light emitting diodes, the light emitting diode comprising a capacitance sensor.

* * * * *